US005240148A

United States Patent [19]

Elgazzar et al.

[11] Patent Number: 5,240,148

[45] Date of Patent: Aug. 31, 1993

[54] CONTAINER VALVE LID

[76] Inventors: Clement S. Elgazzar; Sabet Elgazzar, both of 1360 Fern Hill La., Concord, Calif. 94521

[21] Appl. No.: 910,514

[22] Filed: Jul. 8, 1992

[51] Int. Cl.[5] ..... B65D 37/00

[52] U.S. Cl. ..... 222/206

[58] Field of Search ..... 222/206, 207, 210, 212, 222/544, 546, 547, 556, 561, 562, 563

[56] References Cited

U.S. PATENT DOCUMENTS 2,761,833 9/1956 Ward ..... 222/207

3,143,253 8/1964 Lindgren et al. ..... 222/563

3,469,748 9/1969 Meyers ..... 222/563

*Primary Examiner*—Jesus D. Sotelo

*Attorney, Agent, or Firm*—Leon Gilden

[57] ABSTRACT

A valve lid structure includes a valve member mounted fixedly within a container outlet neck permitting one-way flow through the outlet neck of the container. The valve is formed with a sealing outer wall secured within the outlet neck having a spring-biased door plate permitting one-way flow therethrough. The invention is arranged to further include a shroud member removably mounted relative to an upper end of the valve portion upon projection from the outlet neck of the container.

4 Claims, 4 Drawing Sheets

FIG. 1
PRIOR ART
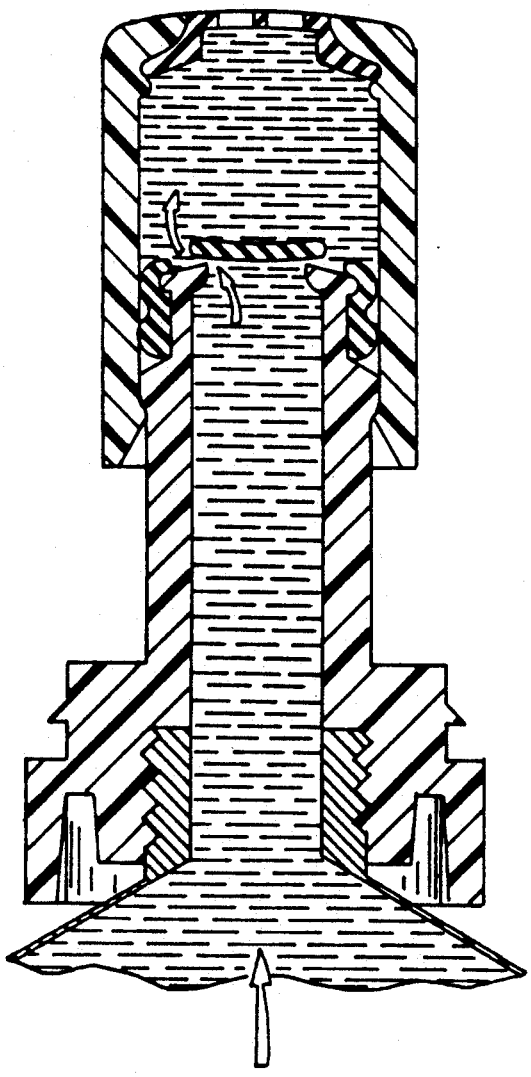
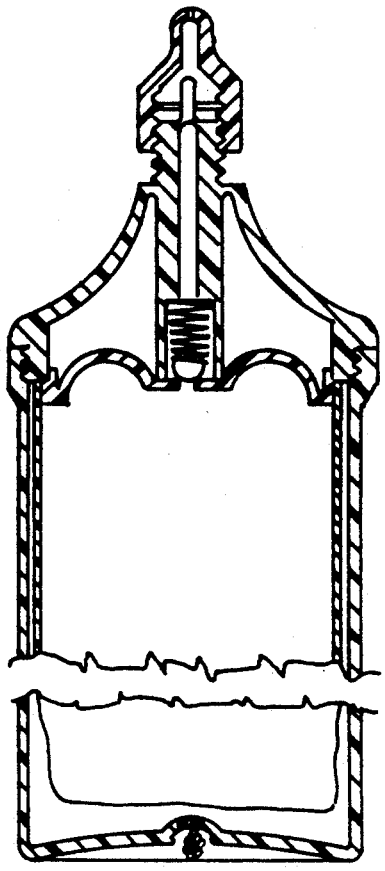
FIG. 2
PRIOR ART

CONTAINER VALVE LID

BACKGROUND OF THE INVENTION

1. Field of the Invention

The field of invention relates to container apparatus, and more particularly pertains to a new and improved container valve lid to effect metering of a pourable fluid from within a container and preventing entrance of fluid into the container.

2. Description of the Prior Art

Typically in the use of shampoo type fluids and the like, water from a bathing event such as a shower and the like is permitted to enter the shampoo to dilute the shampoo fluid therewithin. The instant invention attempts to overcome deficiencies of the prior art by providing for a container valve lid preventing access of fluid interiorly of a container preventing dilution of shampoo type fluid therewithin. Various devices have been used to dispense flowable materials from within a container, wherein U.S. Pat. No. 4,909,416 to Evezich sets forth a container having a check ball mounted within a lower distal end of a conduit integrally mounted within the container outlet portion.

U.S. Pat. No. 4,941,598 to Lambelet, Jr. et al. sets forth an outlet conduit of a container having a telescoping expandable chamber providing flow from the outlet neck to the expandable chamber for subsequent flow exteriorly of the container.

The prior art has heretofore typically utilized relatively complex and cumbersome structure minimizing its use and access to individuals wherein the instant invention attempts to overcome such deficiencies by providing for a compact valve head mounted relative to an outlet neck of a container and in this respect, the present invention substantially fulfills this need.

SUMMARY OF THE INVENTION

In view of the foregoing disadvantages inherent in the known types of container outlet structure now present in the prior art, the present invention provides a container valve lid wherein the same is arranged to permit one-way flow through a container neck preventing access of diluting fluid into the container. As such, the general purpose of the present invention, which will be described subsequently in greater detail, is to provide a new and improved container valve lid which has all the advantages of the prior art container apparatus and none of the disadvantages.

To attain this, the present invention provides a valve lid structure including a valve member mounted fixedly within a container outlet neck permitting one-way flow through the outlet neck of the container. The valve is formed with a sealing outer wall secured within the outlet neck having a spring-biased door plate permitting one-way flow therethrough. The invention is arranged to further include a shroud member removably mounted relative to an upper end of the valve portion upon projection from the outlet neck of the container.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container valve lid which has all the advantages of the prior art container apparatus and none of the disadvantages.

It is another object of the present invention to provide a new and improved container valve id which may be easily and efficiently manufactured and marketed.

It is a further object of the present invention to provide a new and improved container valve lid which is of a durable and reliable construction.

An even further object of the present invention is to provide a new and improved container valve lid which is susceptible of a low cost of manufacture with regard to both materials and labor, and which accordingly is then susceptible of low prices of sale to the consuming public, thereby making such container valve lids economically available to the buying public.

Still yet another object of the present invention is to provide a new and improved container valve lid which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic cross-sectional illustration of a prior art container conduit valve structure.

FIG. 2 is an orthographic cross-sectional illustration of a further example of a container conduit valving structure.

DESCRIPTION OF THE PREFERRED EMBODIMENT

Figure 3:
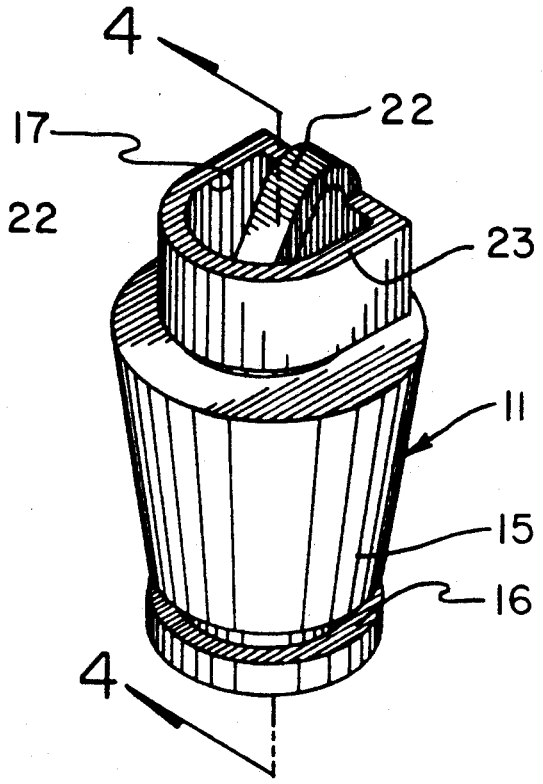
FIG. 3 is an isometric illustration of the container valve structure of the invention.
Figure 4:
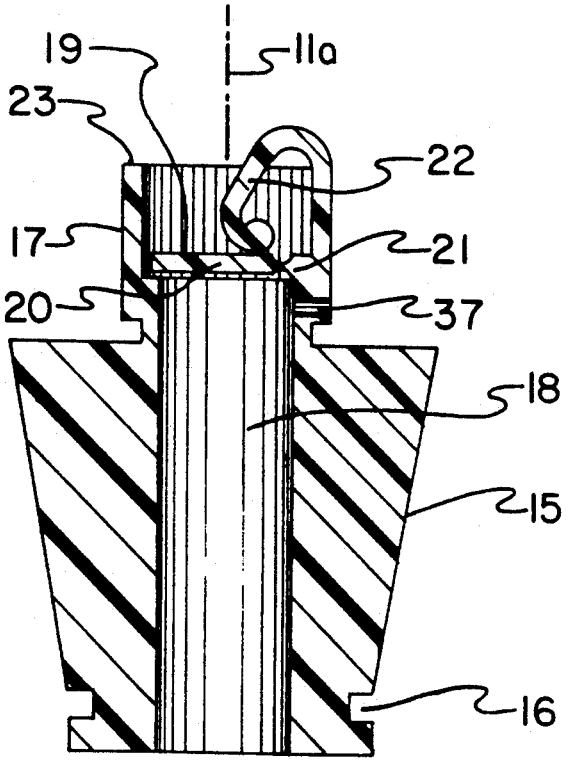
FIG. 4 is an orthographic view, taken along the lines 4—4 of FIG. 3 in the direction indicated by the arrows.
Figure 5:
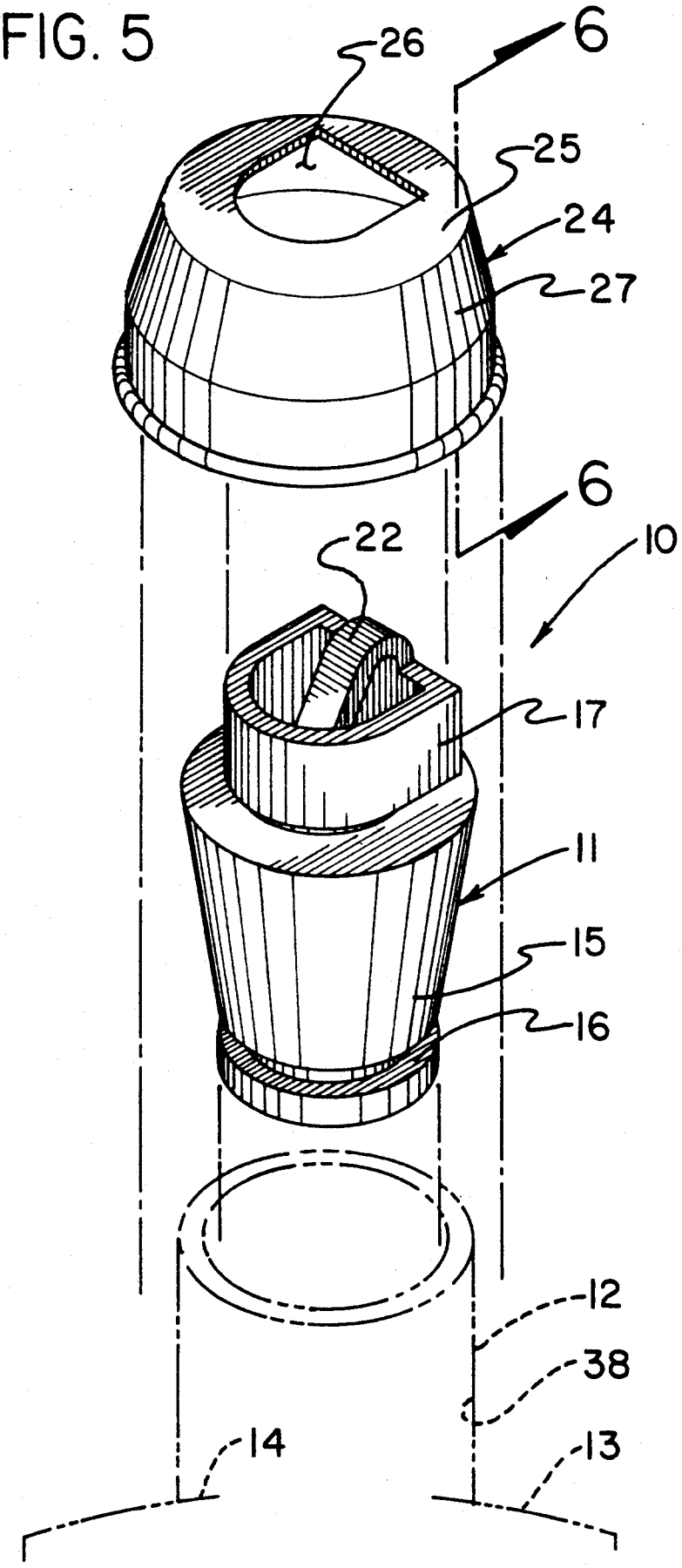
FIG. 5 is an isometric exploded illustration of the container valve id mounted within a container utilizing an optional shroud structure.
Figure 6:
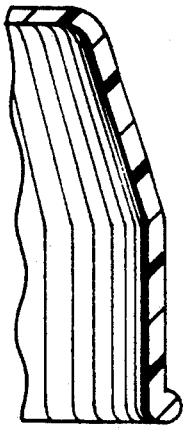
FIG. 6 is an orthographic view, taken along the lines 6—6 of FIG. 5 in the direction indicated by the arrows.

With reference now to the drawings, and in particular to FIGS. 1 to 8 thereof, a new and improved container valve lid embodying the principles and concepts of the present invention and generally designated by the reference numeral 10 will be described.

FIG. 1 illustrates a prior art container valving structure, as indicated in U.S. Pat. No. 4,909,416 directing fluid flow through a one-way check valve at a lower distal end of the container neck. U.S. Pat. No. 4,941,598 is indicated in FIG. 2 having an expandable dosing chamber mounted above the outlet neck of the container structure relative to a telescoping sleeve.

More specifically, the container valve lid 10 of the instant invention essentially comprises the use of a valve insert head 11 mounted within a container outlet neck 12 and associated container body 13. An annular neck flange 14 is formed within the container outlet neck 12 and received within an annular groove 16 directed into the insert head's side wall 15, wherein the side wall 15 is formed as a resilient truncated conical configuration to insure sealing within the container neck 12. A valve outlet conduit 17 is coaxially aligned along a head axis 11a, with a central valve bore 18, with a door plate 20 pivotally mounted about a door plate hinge 21 at an interface between the central valve bore 18 and the valve outlet conduit 17. A semi-annular seat flange 19 is formed at a lower distal end of the valve outlet conduit 17 for receiving the door plate 20 thereon. A spring finger 22 is mounted at its first end to the outlet conduit's upper distal end 23 and is directed into the valve outlet conduit 17 imposing upon a top surface of the door pate 20 to normally bias the door plate into communication with the seat flange 19. It should be noted that the seat flange 19 is of a substantially orthogonal relationship relative to the head axis **11*a*. In this manner, fluid flow from within the container is permitted in only the one-way manner through the central valve bore 18 and the associated valve outlet conduit 17**.

A shroud 24 is arranged for optional reception of the valve outlet conduit 17. The shroud 24 includes a shroud top wall 25 having a top wall opening 26 complementarily receiving the exterior surface of the outlet conduit 17 therethrough. The shroud 24 includes a skirt 27 outwardly flared relative to the shroud top wall 25 extending downwardly relative to the top wall to direct water exteriorly from the container outlet neck 12.

Figure 7:
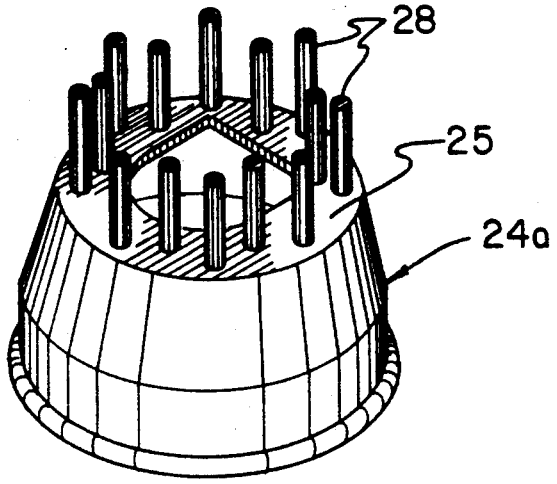
FIG. 7 is an isometric illustration of the shroud structure formed with a brush head.

A modified shroud 24 is indicated in FIG. 7 having a matrix of bristle members 28 mounted thereon to provide for a scrubbing action by use of the bristle structure.

Figure 8:
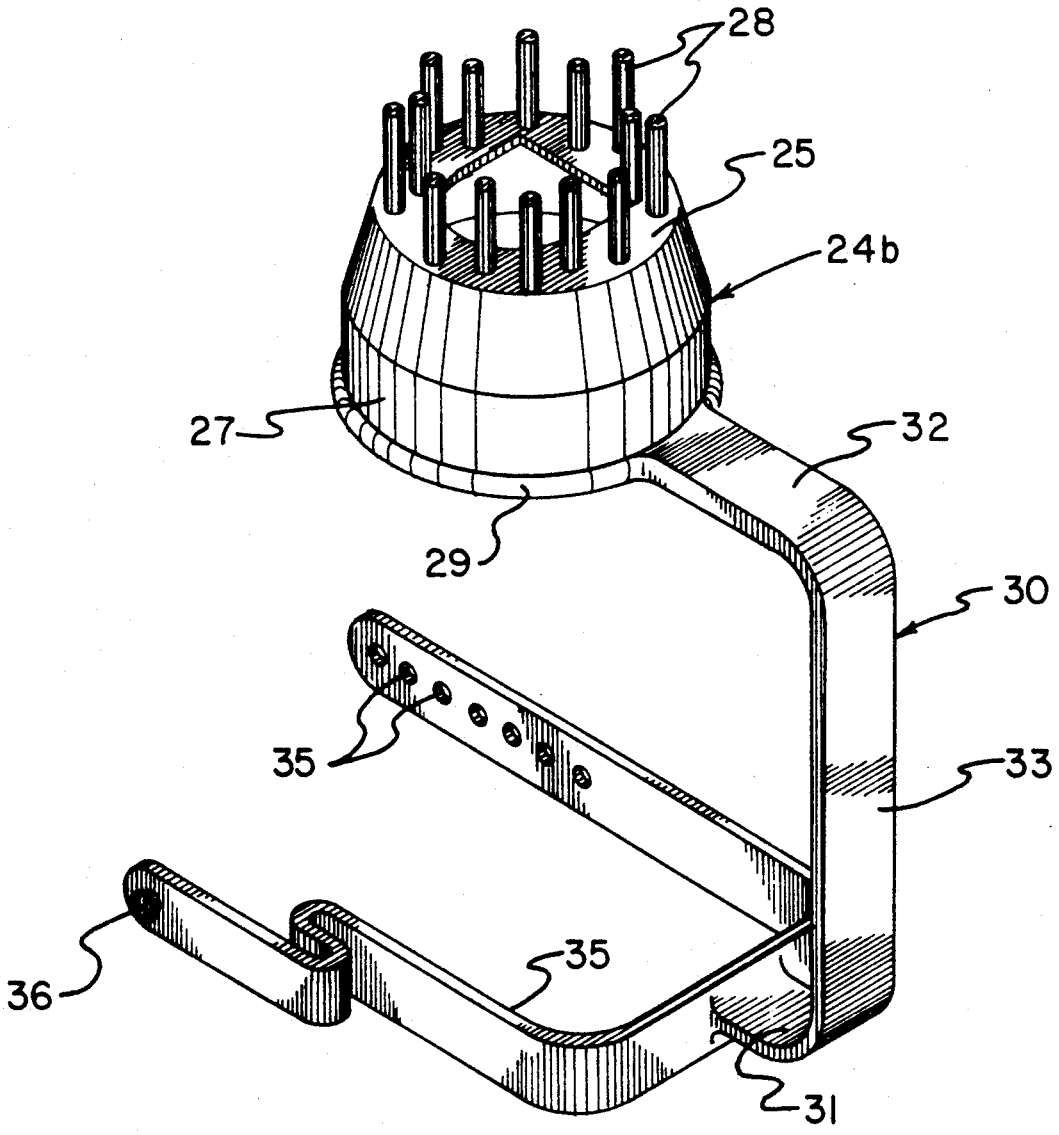
FIG. 8 is an isometric illustration of the shroud structure mounting a handle for securement about an associated container body.

A modified shroud structure **24*b*, as indicated in FIG. 8, includes in addition to the bristle members 28 a rigid U-shaped handle 30 mounted to a skirt lower annular edge 29 of the skirt 27. The handle 30 includes a lower leg 31 spaced from and parallel an upper leg 32 having a central web 33 directed therebetween. The rigid handle 30 fixedly mounted to the skirt lower annular edge 29 extends below the skirt, with the handle lower leg 31 including a strap member 34 having a first end and a second end, with strap apertures 35 directed into the strap 34 from the first end and a strap projection 36 directed into the strap from the second end, with the projection 36 arranged for selective securement about one of the apertures 35 for securement about the container body 13. It should be noted that to insure venting of the container, a vent bore 37 is directed into the valve outlet conduit 17 for permitting venting within the container as required. The vent bore 37 may he further coaxially aligned with a container neck bore 38 (see FIG. 5) as required should the valve outlet conduit 17 be positioned within the container outlet neck 12** below its upper edge.

The handle structure 30, as indicated in FIG. 8, is arranged for removal relative to the container for the scrubbing relative to a shampooing procedure for ease of manipulation of the bristle brush structure, while the shroud, when mounted upon the container neck, provides for directing of moisture exteriorly of the container outlet neck portion.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A container valve lid, comprising, a container member having a container body, the container body including a container outlet neck, and a valve insert head mounted within the container outlet neck, and the valve insert head including a resilient side wall sealingly received within the container outlet neck, and the valve insert head further including a valve outlet conduit, and a central valve bore coaxially aligned with the valve outlet conduit, and a semi-annular seat flange mounted at an interface between the valve outlet conduit and the central valve bore, and a door plate hingedly mounted about a door plate hinger received upon the semi-annular seat flange, with the door plate mounted within the valve outlet conduit for sealingly being received upon the seat flange, and the valve side wall includes an annular groove, and the container outlet neck includes an annular flange received within the groove to position the insert head within the container outlet neck, and the valve outlet conduit includes a conduit upper distal end, and a spring finger having a first end secured to the upper distal end, and the spring finger including a second end in contiguous communication with the door plate to bias the door plate in communication with the seat flange.

2. A container valve lid as set forth in claim 1 including a shroud member, the shroud member including a shroud top wall, the shroud top wall including a top wall opening, the top wall opening receiving the valve outlet conduit therethrough, and the shroud including a shroud skirt depending downwardly and outwardly relative to the shroud top wall to direct fluid exteriorly of the container outlet neck.

3. A container valve lid as set forth in claim 2 wherein the shroud top wall includes a matrix of bristle members fixedly mounted thereon in surrounding relationship relative to the top wall opening, and the shroud skirt including a skirt lower annular edge, the lower annular edge including a rigid U-shaped handle fixedly mounted to the lower annular edge extending downwardly therefrom, wherein the handle includes a lower leg spaced from an upper leg, with the upper leg fixedly mounted to the skirt lower annular edge, and a central web interconnecting the lower leg and the upper leg, and a strap member mounted to the lower leg, with the strap member including fastening means for securement about the container.

4. A container valve lid as set forth in claim 3 wherein the fastening means includes a plurality of strap apertures directed through the strap and a strap projection spaced from the strap apertures, wherein the strap projection is selectively directed through one of said strap apertures securing the container within the strap member.

* * * * *